United States Patent [19]

Lehr et al.

[11] Patent Number: 4,736,561

[45] Date of Patent: Apr. 12, 1988

[54] ROOF DECK CONSTRUCTION

[75] Inventors: Dale A. Lehr; Charles L. Nunley, both of Dallas, Tex.

[73] Assignee: Loadmaster Systems, Inc., Dallas, Tex.

[21] Appl. No.: 757,122

[22] Filed: Jul. 19, 1985

Related U.S. Application Data

[63] Continuation of Ser. No. 330,335, Dec. 14, 1981, abandoned, which is a continuation of Ser. No. 603,892, Aug. 11, 1975, abandoned, which is a continuation-in-part of Ser. No. 231,642, Mar. 3, 1972, abandoned.

[51] Int. Cl.[4] ..... E04B 5/00

[52] U.S. Cl. ..... 52/410; 52/199; 52/801; 52/747

[58] Field of Search ..... 52/618, 630, 302, 305, 52/537, 404, 407, 309, 747, 748, 408, 410, 801, 478, 409, 199, 593, 801, 795, 796, 797, 798, 799, 480

[56] References Cited

U.S. PATENT DOCUMENTS

| | | | |
|---|---|---|---|
| 1,403,510 | 1/1922 | Loucks | 52/795 X |
| 1,426,872 | 8/1922 | Hummert | 52/799 X |
| 1,574,586 | 2/1926 | Louks et al. | 52/537 X |
| 2,076,989 | 4/1937 | Horpham | 52/537 |
| 2,314,449 | 3/1943 | Hoggath | 52/593 X |
| 2,345,221 | 3/1944 | Swenson | 52/409 |
| 2,887,192 | 5/1959 | Schaub et al. | 52/478 X |
| 2,971,616 | 2/1961 | Bayley et al. | 52/618 X |
| 3,482,367 | 12/1969 | Curran | 52/618 X |
| 3,593,478 | 7/1971 | Mason | 52/302 |
| 3,598,688 | 8/1971 | Bellamy | 52/302 X |
| 3,619,961 | 11/1971 | Sterrett et al. | 52/309 X |
| 3,641,724 | 2/1972 | Palmer | 52/407 X |
| 3,763,614 | 10/1973 | Hyde et al. | 52/309 |
| 3,842,559 | 10/1974 | Payne | 52/309 |
| 3,909,998 | 10/1975 | Simpson et al. | 52/618 |

FOREIGN PATENT DOCUMENTS

| | | | |
|---|---|---|---|
| 1328878 | 11/1963 | France | 52/618 |

OTHER PUBLICATIONS

*Sweets Architectural Catalog* 1962, pp. 26–27 of section 21/Fe, Fenestra Inc., "Holorib acoustic roofs".

*Primary Examiner*—Carl D. Friedman
*Attorney, Agent, or Firm*—Crutsinger & Booth

[57] ABSTRACT

A method of building a roof wherein a horizontally disposed roof deck assembly is formed comprising: a sheet of corrugated steel material, preferably having a symmetrical rib pattern wherein the quantity of steel is equally distributed above and below a neutral axis; a sheet of insulation material; and a sheet of rigid substrate material mechanically fastened together by screws. The screws extend through the rigid substrate and through ridges on the upper side of the corrugated sheet material to restrain the ridges from above against lateral distortion under loading, thus forcing the corrugated sheet to maintain its shape and operate to capacities in excess of its expected or predictable flexural load capabilities. The roof deck assembly is secured to a supporting structure and suitable adhesive material, such as asphalt, is employed for securing a waterproof covering thereover. Ventilation apparatus is provided to control temperature and pressure of air in channels between the upper surface of the corrugated sheet and the lower surface of the substrate; and the upper surface of the corrugated sheet has a reflective surface to reflect heat into the channels.

8 Claims, 3 Drawing Sheets

EMPIRICAL DATA CURVE
MEAN AVERAGE CURVE
C
N
NAKED HEAVY DUTY STEEL
UNIFORM LOAD - P.S.F.
160
150
140
130
120
110
100
90
80
70
60
50
40
30
20
10
0
4'-0"
4'-6"
5'-0"
5'-6"
6'-0"
6'-6
6'-8"
7'-0"
7'-6"
8'-0"
SPAN (1/240 DEFLECTION LIMIT)

ROOF DECK CONSTRUCTION

This is a continuation of application Ser. No. 06/330,335 filed Dec. 14, 1981; which is a continuation of Ser. No. 05/603,892, filed Aug. 11, 1975; which is continuation-in-part of Ser. No. 05/231,642 filed Mar. 3, 1972, now all abandoned.

BACKGROUND OF INVENTION

The current state of the art in roof deck construction for commercial, residential, and industrial buildings is controlled very rigidly in the United States. This control has been generated by legislation primarily at the state and local levels through the adoption of state and local building codes which set forth very specific performance factors. All roof decks, in order to comply with these regulations, must meet established performance standards. In general, these performance standards are divided into two broad areas: (1) Sloped roof decks, generally 30 degrees or greater from horizontal and (2) Flat roof decks, 0 degrees to 30 degrees slope from horizontal.

The performance standards for flat roof deck construction vary slightly from area to area but generally conform to the following:

1. Vertical Load Strength: A roof deck must be able to carry a total load consisting of dead load plus live load and not exceed legislated design or performance values for the materials being utilized in the roof deck assembly.

Example: Conventional steel roof decks manufactured from 50,000 to 60,000 psi steel must not be stressed under working conditions beyond a flexural tensile stress of 20,000 psi.

2. Live Load Deflections: While supporting the designed dead load (weight of steel deck, built-up roof and insulation) the roof deck must not deflect under live load application more than 1/240th of the distance between the support members.

Example: A roof deck supported by members 6'0" on center must not deflect more than 6'0"×12 in./ft.×1/240 equal 0.30" under live load application. Live loads will vary in different climate areas from 20 pounds per sq. ft. to 60 lbs./sq. ft., depending upon weather conditions.

3. Wind Up-Lift Resistance: While not at this time in complete use by all code bodies, this performance requirement is being adopted fairly rapidly and currently is in use in many areas. Under wind loadings from storms, hurricanes, etc., the roof deck must resist negative and positive pressures applied to it and remain structurally serviceable. Performance values for this standard vary depending upon geographical areas, but in general, range from 30 psf uplift resistance (equivalent of 100 mph winds) to 90 psf uplift resistance (equivalent of 188 mph winds).

Heretofore steel roof deck assemblies have utilized sections formed from mild steel in patterns normally referred to as "Type A", "Type B", "Type AB", and the like. The common feature of the sections is a wide flat surface element, formed between stiffening ribs that provide the stiffness and strength to the section. The steel sections, supported by purlins, have been designed heretofore to meet strength requirements specified by building codes. The flat surfaces has been employed to provide a supporting surface for one or more layers of sheet material comprising a single board serving to insulate and provide a surface to which waterproof covering was attached.

A typical "Type A" section, for example, provides a flat portion of approximately 5½ inches wide between 1½ inch deep stiffening ribs that are spaced six inches apart. The "Type B, AB" and other sections are similar in profile to a Type A section except that the flat portions between stiffening ribs is progressively reduced in width to create a closer spacing of the stiffening ribs, increasing the load capacity for a given span. However, the width of rib openings on the top surface of the sheet, for example of a Type B section is greater than that of a Type A section.

The most efficient light gauge steel sections from a strength standpoint are those that have the greatest number of stiffening ribs per unit of width; the ultimate, being the symmetrical rib pattern sections, which have an equal distribution of steel above and below a neutral axis lying in a plane passing through the center of the sheet and disposed parallel with upper and lower surfaces of the sheet.

The symmetrically corrugated sheet section is not new to the construction industry and has been utilized for many years as siding and roofing. However, the symmetrically corrugated configuration has not been used in flat roof dry installed roof deck construction because it does not comply with the required performance standards when installed in conventional manner. While theoretically being able to support design loads, in practical use the section bends and distorts under loading, therefore destroying its load carrying capabilities. The sections exhibit poor flexural capabilities in deflection and therefore cannot satisfy the deflection requirements specified by building codes.

It may be mandatory in some cases, or desirable in other cases, for economy reasons, to utilize the roof deck assembly as a structural diaphragm to reinforce a building against lateral loads created by earthquake shocks (sesmic), explosion forces or wind. In such application, the roof deck assembly is considered to be the plate web of a girder oriented in a horizontal plane with the perimeter members of the building serving as the compression and tension chords of the girder.

The diaphragm (plate web) strength of a given roof deck assembly is evaluated in terms of its ability to transfer diagonal tension stresses, which involves consideration of the shear resistance of the assembly, and in-plane deflection (referred to as "diaphragm deflection"), which is governed to a large extent by the "diaphragm stiffness" of the steel panel sections that are utilized. Diaphragm stiffness is related to the ability of the steel panel sections to resist distortion under load.

It is generally known that an "ideal" diaphragm would consist of a thin plane sheet or membrane attached to a structure in such a way (at the support level) that it can resist shear forces through diagonal tension field action. Heretofore it has not been possible, however, for a steel roof deck assembly to function as an "ideal" diaphragm because to satisfy their purpose, roof deck assemblies are also required to support vertically imposed loads which requires rib construction hereinbefore described. Accordingly, the diaphragm stiffness that a given steel panel section can provide depends on the orientation of the steel in the section to the stress plane, which is located at the immediate top of the supporting purlins. In this respect, flat profile steel panel configurations wherein most of the steel is elevated above the support level (the stress plane) have less diaphragm stiffness than sections that provide more steel nearer to the stress plane such as a symmetrical rib pattern.

Since the flexural strength of a steel panel section is, to a large degree, a function of the depth of the section, it is naturally opposed to the reduction of depth (approaching a thin plane of steel) that contributes to diaphragm strength. The most efficient roof deck assemblies, from the standpoint of diaphragm strength, are those that can provide adequate flexural strength, utilizing steel sections with the maximum degree of effective steel in the diaphragm stress plane. Diaphragm stiffness increases proportionally to increases in the yield strength of the steel that is utilized, hence, steel sections made of high tensile steel are more effective than those made of mild steel.

Heavy gauge, mild steel (for example, 22 gauge, 20 gauge and 18 gauge with a stress limit of 20,000 lbs. per square inch) is generally employed in the manufacture of Type A and similar flat profile sections. This has been due to the fact that heavier gauges are necessary to satisfy the minimum steel thickness to element-width ratios that govern the design of light gauge steel sections. On the other hand, the symmetrical rib pattern sections have smaller unit-width elements and hence can utilize the more effective high tensile strength steel in lighter gauges providing greater working strength per pound of steel.

Asphalt built-up roof coverings usually consist of several layers of asphalt-saturated felt with a continuous layer of hot-mopped asphalt between the layers of felt. The top layer of such a roof covering may consist of a hot mopping of asphalt or coal tar pitch only, a top pouring of hot asphalt with slag or gravel embedded therein, or a mineral-surfaced cap sheet embedded in a hot mopping of asphalt.

Built-up roofs cannot generally be applied directly to steel roof deck sections and consequently an underlayment of substrate material has heretofore been installed after the steel roof deck sections have been secured in place. The single sheet of underlayment material has heretofore been generally referred to as "rigid roof insulation board". However, the insulating efficiency of the rigid board insulation is generally directly related to the density of the materials of which it is constructed, lighter density materials providing proportionally better insulation for a given thickness. Strength characteristics are inversely related to reductions in density. Accordingly, the lighter the density, the less the strength. Since "rigid insulation board" has heretofore been used over steel decks to provide a suitable base for roofing as well as insulation, the board had to be manufactured in densities that would compromise the minimum requirements for strength versus insulation values. Typical of compromised situations, the "rigid insulation boards" have been made to be adequate, but under the circumstances could not be fully efficient in the performance of either function, i.e., providing thermal insulation and strength.

Because of the inherent low strength of "rigid insulation boards" constructed of relatively low density material to provide the desired thermal insulation, the boards had to be fully supported because sufficient strength was not provided to create a structural bridge over wide voids in the surface of the steel roof deck section supporting the insulation board.

The low density material found in a single sheet to serve the dual role of a roof substrate member and an insulating member did not have sufficient internal strength to hold screws or other conventional forms of mechanical fasteners. Consequently, the Type A and similar flat profile sections of steel roof deck sections, having narrow rib openings on the surface, were necessary to provide the support to the board and to provide a sufficiently large contact area to facilitate attachment with hot asphalt or other types of adhesives. Therefore, the less efficient flat profile steel sections have heretofore been employed in lieu of the more efficient symmetrical rib pattern sections which have wide rib openings on the surface.

SUMMARY OF INVENTION

We have developed an improved roof deck assembly comprising: a symmetrically corrugated sheet of material to which a first sheet of insulation material, such as foamed polystyrene, and a second sheet of high density mineral board are mechanically fastened.

The symmetrically corrugated steel section utilized in our invention is not new to the construction industry and has been utilized for many years as siding and sloped roofing. However, the symmetrically corrugated configuration has not been used in flat roof dry installed roof deck construction because it does not comply with the required performance standards specified by building codes. While, theoretically being able to support design loads, in practical use the section bends and distorts under loading, therefore destroying its load carrying capabilities. The sections exhibit poor flexural capabilities in deflection and therefore cannot satisfy the deflection requirements.

The high density mineral board top surface of the roof again is a material that is similar in appearance to many building boards. In most common applications, boards of this type are utilized as interior panels for walls and are regarded by the industry to be non-structural components. "Rigid insulation board" type materials utilized in roof deck construction are also non-structural and in all cases researched board products were not utilized as a structural element but were incorporated for underlayment or insulative purposes. "Rigid insulation board" applied over conventional steel decks do not contribute to the flexural live load capabilities of the assembly.

The low density insulative media sandwiched between the steel and mineral board, again is a material common to the industry. Low density insulation is inherently weak, very lightweight and heretofore has been used as an insulative overlayment with no structural contribution or structural applications. Its primary use has been as a filler or as an over or underlayment material to restrict the passage of heat.

Separate mathematical analysis of the individual components of the roof deck lead to a conclusion that the components cannot be economically employed as a flat roof deck. However, when assembled and secured together such that upper ribs of the corrugated sheet are restrained against lateral movement in a horizontal direction, empirical data reveals that a 47% reduction in the weight of steel required to provide equal flexural performance is possible using 25 gauge symmetrically corrugated steel instead of 20 gauge type "A" steel decking.

When a downwardly directed load is applied to a span of the horizontally disposed corrugated section, upper portions of upwardly extending ribs on the section are in compression; lower portions of downwardly extending ribs being in tension. Since the cross-section of the ribs are very thin compared to the length of the span, when in compression the ribs tend to buckle or shift in a horizontal direction as well as to deflect downwardly.

The flexible, resilient, high density mineral board is mechanically anchored to a symmetrically or non-symmetrically corrugated section of relatively thin material with an anchor pattern of sufficient spacing and frequency to stabilize the corrugated section from lateral distortion under loading, thus forcing the corrugated section to maintain its shape and operate to capacities in excess of its expected or predictable flexural load capabilities.

A structural composite inter-relationship is created between the components (the corrugated section and the mineral board) which forces both components to act in unison in resisting deflection under both positive and negative loading. The establishment of this relationship forces the combination of the components to provide greater resistance than predicted from the total of the individual component capabilities.

A primary object of the invention is to provide a method and apparatus to support thin corrugated sheet to prevent lateral movement of ribs on the corrugated sheet as a result of flexural loading.

Another object is to provide a method and apparatus to stabilize corrugated material such that the weight of a span of the corrugated material required to support a predetermined load is minimized.

Another object is to provide a method and apparatus to ventilate a roof deck to discipate solar heat.

Another object is to provide a highly insulated roof deck adapted to permit transfer of heat through the roof deck when temperature exceeds a predetermined temperature.

Another object of our invention is to provide a roof deck wherein an incombustible water resistant board, having sufficient strength to create a structural bridge over wide rib openings, and a sheet of insulation material are employed in such a manner that efficient high tensile steel symmetrical rib pattern sections of roof deck material may be employed to achieve greater strength than has been achieved heretofore at reduced costs.

Another object of the invention is to provide a roof deck wherein an underlayment comprising a sheet of material having sufficient structural strength to support connection of mechanical anchor members is employed in combination with a sheet of less dense insulation material to permit the use of mechanical fastening apparatus between the underlayment materials and a corrugated sheet of deck material.

A still further object of the invention is to provide a roof deck assembly comprising sheets of material mechanically connected together in a manner permitting prefabrication of sections of a roof deck, said assembly being particularly adapted for prevention of insulation crawl and to provide positive resistance to wind up-lift forces.

Other and further objects of the invention will become apparent upon referring to the detailed description hereinafter following and to the drawings annexed hereto.

DESCRIPTION OF DRAWINGS

Drawings of three embodiments of the invention are annexed hereto so that the invention may be better and more fully understood, in which.

Numeral references are employed to designate like parts throughout the various figures of the drawing.

DESCRIPTION OF PREFERRED EMBODIMENTS

Figure 1:
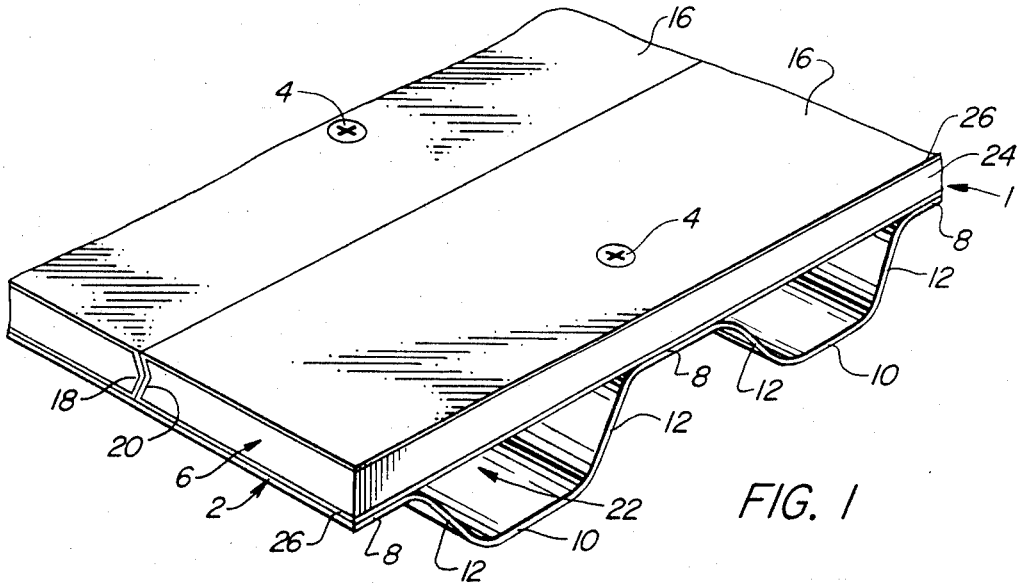
FIG. 1 is a perspective view of a first form of the invention wherein a rigid board is mechanically connected to a corrugated sheet.

Referring to FIG. 1 of the drawing the numeral 1 generally designates a composite roof deck assembly comprising a corrugated sheet 2 supported from below by a purlin P and secured from above by mechanical fasteners 4 to roofing substrate material 6.

Figure 2:
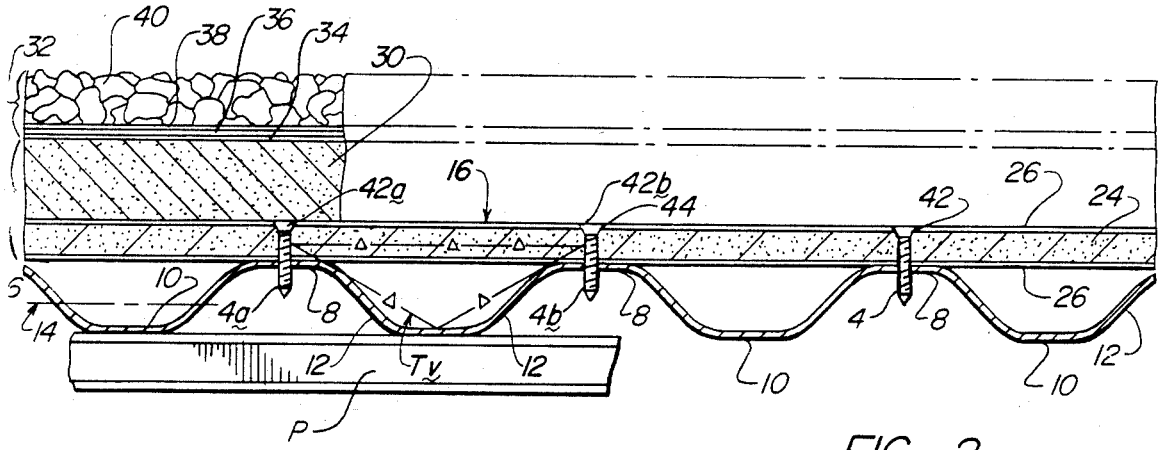
FIG. 2 is a cross-sectional view through a second form of a roof deck assembly wherein insulation material is secured over the rigid sheet.

Corrugated sheet 2 preferably has flat portions 8 and 10 of substantially equal length joined by connector portions 12 providing straight, parallel, regular, and equally curved ridges and hollows. As best illustrated in FIG. 2 this configuration has a substantially equal distribution of surface area of the corrugated sheet above and below a neutral axis 14.

The substrate material 6, illustrated in FIG. 1, comprises a single sheet of smooth, incombustible, water resistant, fiberglass reinforced, mineral board particularly selected to provide resistance to high impact moving and concentrated loads without rupturing, and to contribute to the overall flexural load capacity.

The sheet 6 comprises a plurality of panels 16, each of said panels having a tongue 18 and groove 20 formed on opposite edges thereof to provide for continuous interlocking of roofing substrate panels to create a barrier against pitch leakage, to minimize joint movement under moving and concentrated loads, and to provide a resistance to wind up-lift forces.

The formation of a built-up roof generally involves application of asphalt or other suitable adhesive material to the substrate for forming a waterproof covering to which may be applied a protective layer of natural gravel or suitable natural aggregate.

Figure 5:
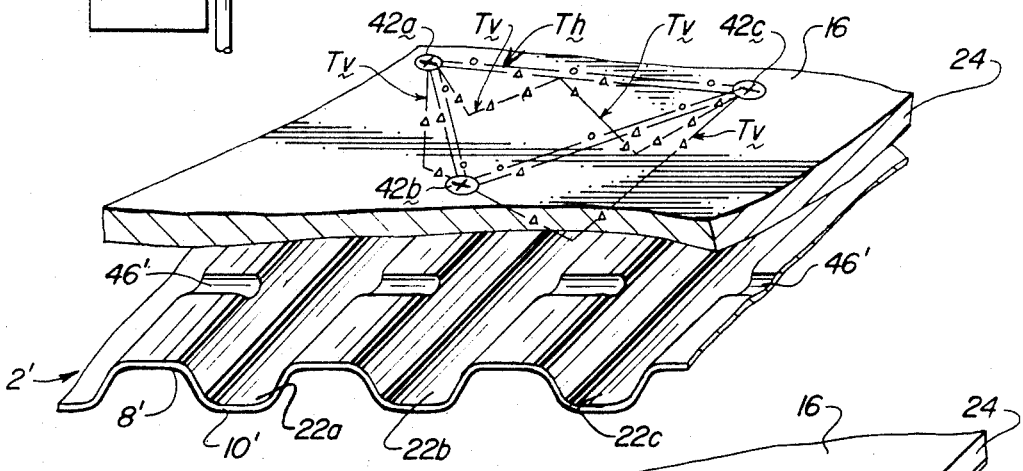
FIG. 5 is a fragmentary perspective view illustrating a second form of ventilating apparatus.

In the particular embodiment of the invention illustrated in FIG. 1, insulating qualities of the composite roof deck assembly is considered secondary. Panels 16 are relatively high density material having sufficient strength to create a structural bridge over the wide rib openings 22. As best illustrated in FIGS. 2 and 5 of the drawing, spaced screws 4*a*, 4*b* and 4*c*, having screw heads 42*a*, 42*b*, and 42*c* are oriented in a pattern to form a series of generally triangular shaped horizontallly disposed trusses $T_h$ and a series of vertically disposed trusses $T_v$ throughout the length and width of spans between spaced purlins P to increase the resistance to horizontal and vertical planar deflection of the roof deck. Panel 16 of composite board, comprises a rigid core 24 of gypsum and other known ingredients faced on both sides and edged with layers 26 of permeable water-resistant paper. The general configuration and composition of the materials of panels 16 corresponds to that of exterior gypsum sheathing board commercially available from George Pacific Company and U.S. Gypsum Company, except that 5 to 15% by volume of glass fibers is added to increase the strength thereof.

Figure 3:
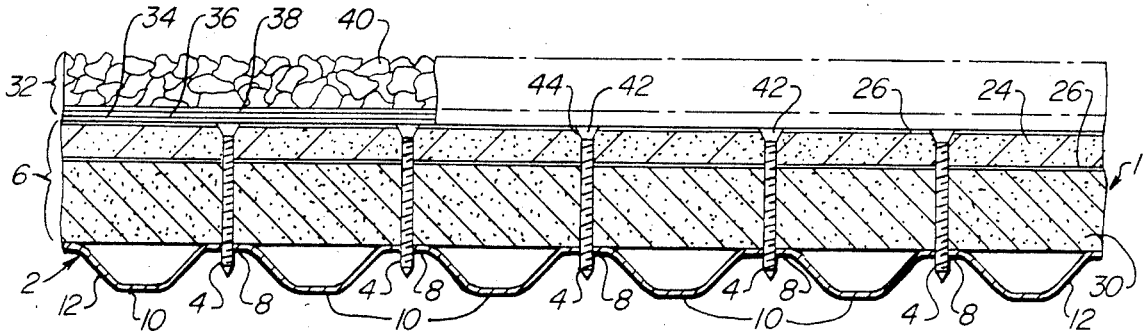
FIG. 3 is a cross-sectional view of a third form of the invention wherein a sheet of insulation material is disposed between spaced sheets of corrugated material and rigid material.

The forms of the device illustrated in FIGS. 2 and 3 of the drawing are similar to that hereinbefore described and illustrated in FIG. 1 except that a layer or sheet 30 of thermal insulation material is employed in combination with panels 16 of rigid material to provide desired insulating qualities.

Sheet 30 of insulation material preferably comprises incombustible foamed polystyrene which is recognized by persons having ordinary skill in the art as a highly efficient and economical insulation material. Such material is commercially available under the trademark, "CELLULITE" manufactured by Gilman Brothers Company of Gilman, Conn. However, it should be appreciated that other insulation material such as polyurethane, fiberglass, cork and the like may be employed in combination with or in lieu of the polystyrene.

The sheet 30 of insulation material is preferably formulated such that it has a high degree of thermal insulating quality at ambient atmospheric temperatures. However, the melting point of sheet 30 is preferably less than for example 200° F. such that the foamed insulation material will melt at elevated temperatures. When the foamed plastic melts air entraped in cells is released and the volume of material is greatly reduced.

The insulating qualities of the melted material becomes negligible. Therefore, in the event of fire in a structure covered by the roof deck, the insulating qualities of sheet 30 diminish at elevated temperatures to permit dissipation of heat from corrugated sheet 2 upwardly through mineral board 16. This facilitates maintaining temperature in an attic plenum below critical limits to prevent structural failure of corrugated sheet 2 and purlines P as a result of excessive heating caused by fire.

Standard methods of performing tests to determine resistance of building materials to fire are established by ASTM E119.

In the form of the invention illustrated in FIG. 2 of the drawing, the sheet 30 of insulation material is positioned over panels 16 of rigid material and suitable roof covering is applied thereto.

Some of the more common roof covers include slate, composition or wood shingles, composition roofing paper, roofing granules and tile. The type of roof material selected depends to a large extent upon the expense which can be justified in order to secure required performance on the particular building. The particular roof covering 32 illustrated in the drawing comprises a layer of asphalt, applied to the surface of the substrate 6, over which is laid a suitable roofing membrane 36. The second layer 38 of hot asphalt or other suitable adhesive material is applied over membrane 36 and a layer 40 of gravel or other suitable surfacing material is applied thereto.

In the form of the invention illustrated in FIG. 2 the roofing substrate 6 comprises a sheet 30 of insulation material positioned over a rigid sheet or panel 16. In the form of the invention illustrated in FIG. 3 the substrate 6 comprises a rigid sheet 16 positioned over a sheet 30 of insulation material. In each of the forms of the invention the substrate 6 is secured by threaded screw 4 to upper ridge portions of the corrugated sheet 2.

It should be noted that screws 4 have enlarged heads 42 on the end thereof which engage the rigid sheet 16 in each of the forms of the invention. As hereinbefore noted, sheet 30 of insulation material generally is of relatively low density and consequently has insufficient internal strength to hold a screwhead 42 without pulling through the material as a result of wind lift force. It should be appreciated that wind blowing against the surface of a roof creates a positive pressure on the windward side thereof and a suction on the leeward side.

Screw holes formed in the rigid sheet 16 are preferably countersunk as illustrated at 44 to receive screw heads 42, providing a smooth uniform upper surface.

The preferred embodiment of the invention is illustrated in FIG. 3 wherein the insulation material 30 is disposed in a sandwiched position between corrugated sheet 2 and the rigid sheet 16 such that the sheet 30 is in a protected position and any loading applied to the upper surface of the outer covering 32 of the roof will be distributed by rigid sheet 16 over a substantial area of the sheet 30 of insulation material preventing damage thereto even though the sheet 30 in most instances will have relatively low internal strength.

From the foregoing it should be readily apparent that we have developed an improved roof deck assembly which in the preferred embodiment illustrated in the FIG. 3 has a substrate 6 comprising a rigid sheet 16 and a less dense sheet 30 of insulation material mechanically connected by fasteners 4 to a corrugated steel sheet 2.

The particular construction of the improved roof deck assembly 1 provides a flat surface having sufficient strength to support a roofing membrane 32 and permits use of the symmetrical rib pattern in the corrugated sheet 2 which provides both flexural strength and diaphragm stiffness when the upper ridges 8 are restrained against movement in a horizontal direction by the flat sheet 16 and mechanical fasteners 4.

The upper portions of the upper ridges 8 are in compression when a downwardly directed force is applied to the upper surface of the roof deck. The upper portions of ridges on the thin gauge corrugated sheet 2 are somewhat analogous to a slender column when in compression. Screws 4 are positioned such that the unsupported length of the thin ridges is such that buckling is minimized.

It should be readily apparent that sheet 2 of corrugated material, having a symmetrical rib pattern above and below a neutral axis 14, is positioned across horizontally disposed purlins P to form a horizontal span of corrugated material. The flat horizontally disposed sheet 16 of high density material is positioned above and extends perpendicular to the ribs in the horizontally disposed sheet of corrugated material. Mechanical fasteners 4 extend thorugh the flat sheet and through upwardly extending ribs on the corrugated sheet and are oriented in a pattern to form a vertical truss Tv comprising a horizontal section of the flat sheet 16 spanning openings 22 between ribs in the corrugated sheet between adjacent mechanical fasteners 4 and downwardly extending connector portions 12 of the corrugated sheet between the ribs. A horizontal triangular shaped truss Th in the horizontal plane of the sheet, is formed by a triangular segment of the flat sheet 16 restrained by adjacent mechanical fasteners 4 to ribs of a corrugated sheet in the span between purlins P. The trusses Tv and Th are spaced from the purlins P to prevent lateral and vertical distortion of the corrugated sheet 2 as a result of force applied in the plane of the flat sheet 16. The modular structrual composite roof deck functions as a structural diaphragm to provide rigidity to a building. Fasteners 4*a*, 4*b* and 4*c*, oriented in a pattern at horizontally spaced locations transversly of the span and at spaced locations longitudinally of the span, form a series of esentially triangular shaped trusses Th and Tv in the horizontal and vertical planes throughout and across the span, between the purlins, to stabilize and prevent lateral and vertical deformation of the individual ribs of the corrugated sheet 2 to increase the resistance to horizontal and vertical planar deflection of the roof deck.

Air trapped in the space in channels 22 under the sheet 16 generally approximates the atmospheric pressure. However, under wind loadings from storms, hurricanes and the like, the roof deck must resist negative and positive pressures applied to it and remain structurally serviceable.

Rapidly moving air passing above the sheet 16 creates a negative pressure while the atmospheric pressure in channels 22 creates a positive pressure tending to separate sheet 16 from the corrugated sheet 2.

Figure 4:
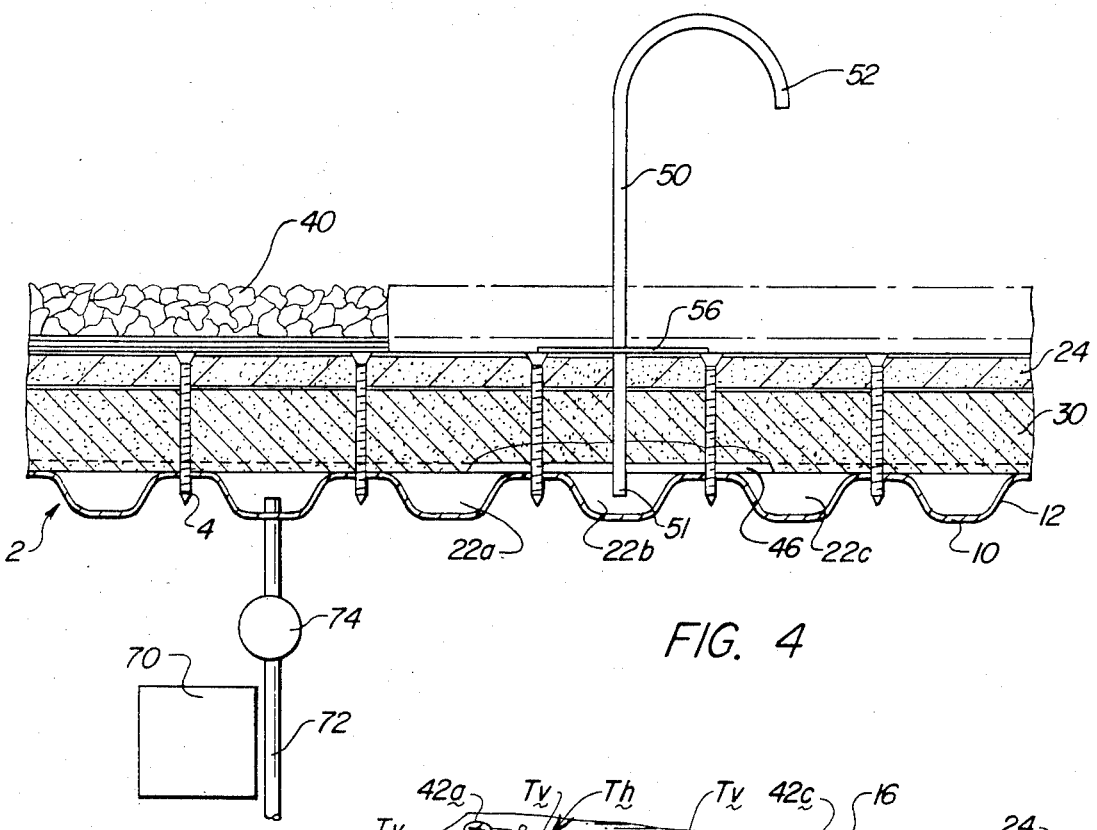
FIG. 4 is a cross-sectional view similar to FIG. 3 illustrating ventilating apparatus associated with the roof deck.
Figure 6:
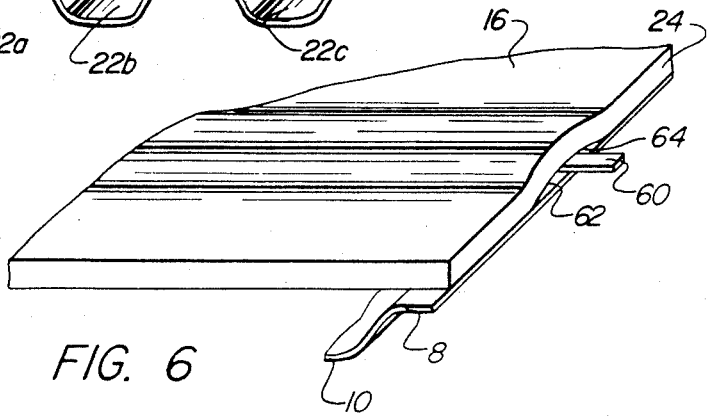
FIG. 6 is fragmentary perspective view illustrating a third form of ventilating apparatus.

Ventilating apparatus to control temperature and pressure of air in channels 22 is illustrated in FIGS. 4–6 of the drawing. Provision of pressure relief means communicating with each of the channels 22 and the corrugated sheet 2 such that a change in air pressure above the sheet 16 is accompanied by a simultaneous change in air pressure in channels in the corrugated sheet below panel 16 minimizes the likelihood that sufficient pressure differential will exist to separate sheet 16 from the stronger corrugated sheet 2.

Three embodiments of the ventilating apparatus are illustrated in the drawings.

In the form of the ventilating apparatus illustrated in FIG. 4 of the drawing, the bottom layer 30 of the roofing substrate 6 has grooves 46 formed therein such that troughs or channels 22*a*, 22*b*, and 22*c* in a corrugated sheet 2 are in fluid communication with each other. Pressure relief means comprising a pipe 50 having a lower end 51 communicating with the inside of at least one of the troughs 22 extends through substrate 6 and has a crooked upper end 52 communicating with atmosphere above the roof assembly 32. Flashing 56 is secured to pipe 50 and is covered by waterproofing material to prevent leakage of water therethrough.

From the foregoing it should be readily apparent that each of the troughs 22*a*, 22*b*, and 22*c* is connected by groove 46 such that air pressure in each of the troughs is equal to air pressure above the substrate 32 since pipe 50 communicates therewith.

In the form of the ventilating apparatus illustrated in FIG. 5 corrugated sheet 2' has dents 46' formed in the upper surface of upwardly extending ridges 8' such that the lower surface of sheet 16 of substrate material will bridge dented portions 46' permitting air to flow between troughs 22*a*, 22*b*, and 22*c* and through pipe 50 to atmosphere above sheet 24.

In the embodiment illustrated in FIG. 6, the ventilator apparatus comprises a spacer element 60 which extends across ridges 8 of sheet 2. The sheet 16 is deflected as illustrated in FIG. 6 forming passages 62 and 64 communicating with spaced troughs 22 in the corrugated sheet 2. A vent pipe 50 extends through sheet 16 as hereinbefore described with reference to FIGS. 4 and 5.

Since the upper end 52 of pipe 50 extends vertically above the surface of the roof deck heated air in channels 22 rises such that heat is dissipated through vent pipe 50.

From the foregoing it should be readily apparent that vent pipe 50 controls pressure and temperature of air in grooves 22 which contributes to wind up-lift resistance of the roof deck assembly.

The upper surface of corrugated sheet 2 preferably has a reflective coating on the surface thereof to reflect solar heat passing through the roof back to channels 22 such that the heat is absorbed by air and dissipated through vent pipe 50. The reflective coating may comprise white paint or fine ground aluminum pigmented paint to form a reflective surface.

When a roof is employed over a structure having high relative humidity inside the structure, moisture condenses on the roof structure during cold weather. To eliminate condensation of moisture on corrugated sheet 2 and to form a vapor barrier between the interior of the building and the roofing substrate, a heat exchanger 70 is positioned in heat exchange relation with a conduit 72 through which air is delivered by a blower 74 into channels 22. Forced circulation of heated air through channels 22 and through grooves 46 maintains the temperature of corrugated sheet 2 above the dew point of air inside the building to prevent condensation.

The heat exchanger 70 is preferably associated with the furnace or other heating system employed for maintaining temperature in the building at a desired level.

From the foregoing it should be readily apparent that while the symmetrically corrugated sheet 2, mineral board 16 and sheet 30 of insulation material appear to exhibit insufficient strength characteristics for forming a roof deck when separately considered, when assembled as hereinbefore explained, a roof deck having strength superior to roof decks heretofore devised is formed.

In view of the unorthodox characteristics and functions of the individual components when assembled in a composite roof deck, mathematical calculation of strength of the composite roof deck is not feasible. However, strength characteristics and comparisons with existing structures have been observed by actual construction and testing of the roof deck. The empirical data has been analyzed and formulated into a predictable pattern by applying known or newly discovered engineering principles. This, in essence, is the method used to establish the performance characteristics of the roof deck assembly hereinbefore described.

Figure 7:
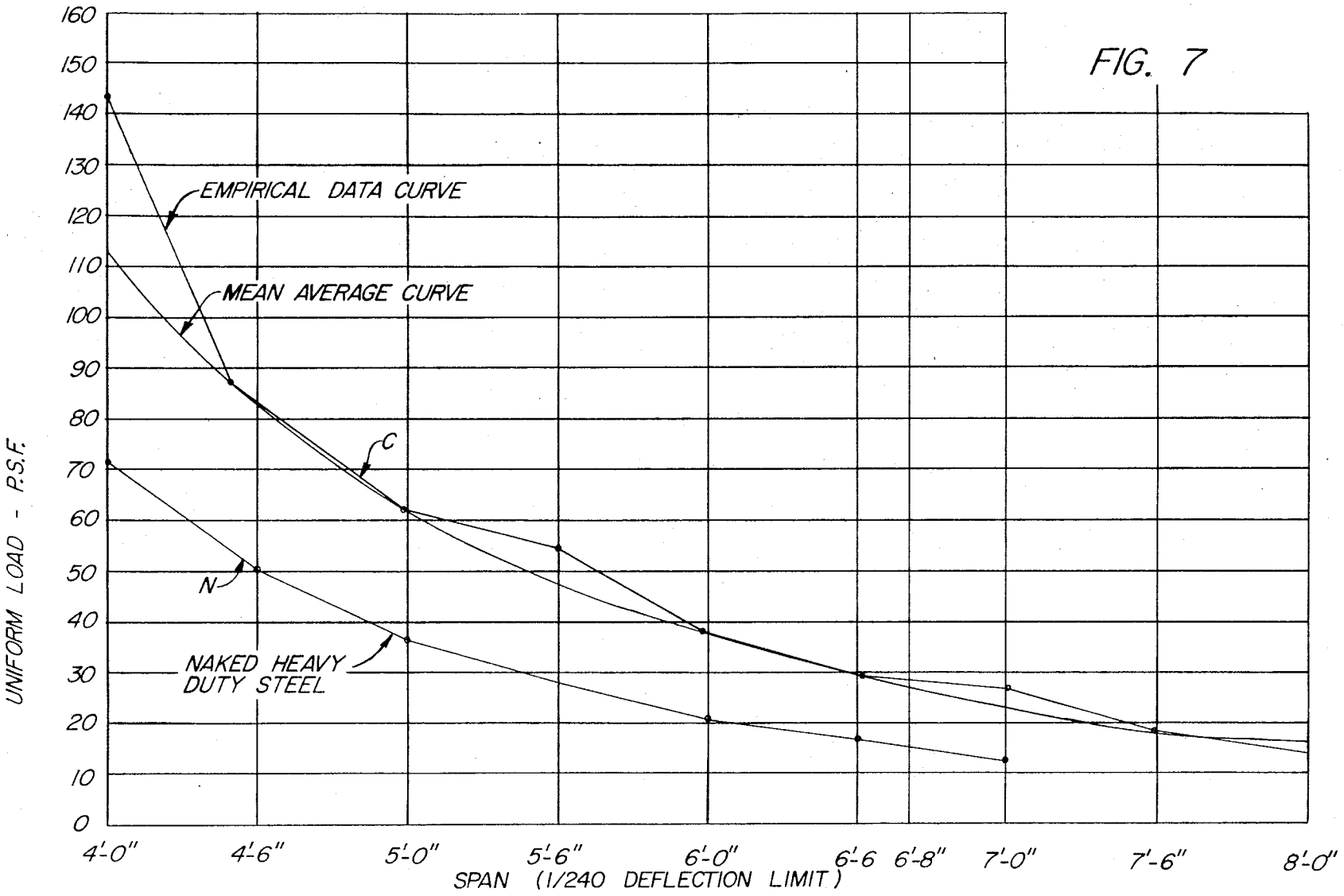
FIG. 7 is a graph illustration flexural strength of the roof deck.

Referring to FIG. 7 of the drawing, line N indicates the uniform load carried by a span of naked steel at various support spacings. The load is that carried by the span wherein the deflection did not exceed 1/240th of the length of the span and the stress limit did not exceed 30,000 psi. Line C indicates the load under the same conditions carried by various spans of the same gauged corrugated steel mounted in a composite roof deck of the type hereinbefore described.

Careful analysis of the graph reveals that the load carrying capability of the composite roof deck indicated by the line C is 175% of the load carrying capability of an identical corrugated sheet to which the mineral board 16 was not attached to the upper surface by fasteners 4. Otherwise stated the weight of steel required to provide the required strength for a given span is 47% less when employing the composite roof deck illustrated in FIG. 1 wherein ridges of the corrugated sheet are anchored.

From the foregoing it should be readily apparent that the method and apparatus hereinbefore described provides a roof deck structure having strength characteristics exceeding that of roof decks heretofore devised while employing thinner gauged steel sheets and providing improved insulating characteristics.

It should be appreciated that other and further embodiments of our invention may be devised without departing from the basic concept thereof.

Having described our invention, we claim:

1. A deck assembly comprising: a sheet of corrugated material, said sheet having a symmetrical rib pattern above and below a neutral axis, said sheet having spaced upper ribs extending upwardly from said neutral axis which are in compression when a force is applied to the sheet and directed normal to said neutral axis and having spaced lower ribs which extend downwardly from said neutral axial which are in tension when a force is applied to the sheet in a direction normal to the neutral axis, said spaced upper and lower ribs extending longitudinally of said corrugated sheet; a flat rigid sheet; means mechanically joining the flat rigid sheet to the spaced upper ribs such that passages are formed between surfaces of said corrugated material and said flat said sheet, and such that the upper ribs are maintained in a fixed relationship relative to each other transversely of the corrugated sheet and such that the upper ribs are braced at spaced intervals longitudinally of said corrugated sheet to prevent buckling of said upper ribs when a force is applied to the upper surface of the corrugated sheet in a direction normal to said neutral axis; a heat exchanger; and means to transfer air in heat exchanger relation with said heat exchanger and discharge heated air into said passages to maintain said sheet of corrugated material at a temperature above the dew point of air adjacent the sheet of corrugated material to prevent condensation of moisture on the sheet of corrugated material.

2. A flat horizontally disposed roof deck comprising: spaced horizontally disposed purlins; a corrugated sheet of high tensile strength steel having a symmetrical rib pattern providing an equal distribution of steel above and below a neutral axis lying in a horizontally disposed plane passing through the center of the sheet, said corrugated sheet being supported from below by said spaced purlins; a sheet of smooth, incombustible, water-resistant, fiberglass reinforced, mineral board above said corrugated shet; a sheet of insulation material between said sheet of mineral board and said corrugated sheet of high tensile strength steel, said sheet of insulation material having grooves formed therein such that spaced troughs between the upper surface of the corrugated sheet and the lower surface of the sheet of insulation material are in fluid communication with each other; a vent means communicating with at least one of said troughts to maintain air pressure in said troughs substantially equal to ambient air pressure; threaded mechanical fasteners extending through the sheet of mineral board and through the sheet of corrugated steel, said fasteners being arranged to mechanically restrain ridges on the upper portion of the corrugated sheet above the horizontally disposed neutral axis in a fixed relationship relative to the sheet of mineral board to prevent horizontal movement of the ridges which would tend to flatten the corrugated sheet when a downwardly directed load is applied to the sheet of mineral board, said threaded mechanical fasteners being spaced along the length of the ridges to prevent buckling of upper portions of the ridges; and a waterproof covering bond to said sheet of mineral board.

3. The roof deck of claim 2 wherein said mechanical fasteners are positioned at spaced locations over the surface of the sheet of mineral board such that each ridge on the upper portion of the corrugated sheet has at least one mechanical fastener extending therethrough.

4. A flat horizontally disposed roof deck comprising: spaced horizontally disposed purlins; a corrugated sheet of high tensile strength steel having upper and lower ribs arranged to form a symmetrical rib pattern providing an equal distribution of steel above and below a neutral axis lying in a horizontally disposed plane passing through the center of the sheet, said corrugated sheet being supported from below by said spaced purlins; means securing said lower ribs below the neutral axis to said purlins to form a span between the purlins; a sheet of smooth, incombustible, water-resistant, fiberglass reinforced, mineral board above said corrugated sheet; a plurality of layers of felt adhered to the surface of the mineral board and bonded together by adhesive material; ventilator means extending above the layers of felt and communicating with passages between said sheet of mineral board and said corrugated sheet, said ventilator means being adapted to control temperature and pressure of air in the passages; and threaded mechanical fasteners extending through the sheet of mineral board and through the sheet of corrugated steel, said fasteners being arranged and spaced over the surface of the sheet of mineral board intermediate to edges of the mineral board to mechanically restrain each ridge on the upper portion of the corrugated sheet above the horizontally disposed neutral axis in a fixed relationship relative to the sheet of mineral board to prevent independent horizontal and vertical movement of each ridge which would tend to flatten or distort the corrugated sheet when a downwardly directed load is applied to the sheet of mineral board, said threaded mechanical fasteners being spaced along the length of the ridges to prevent buckling of upper portions of the ridges, said threaded mechanical fasteners being positioned such that the resistance to uniform and concentrated load deflection of the composite span is greater than the sum of the resistance to deflection of separate similar spans of the corrugated sheet alone and of the mineral board along which are not mechanically joined intermediate opposite ends of the respective spans.

5. A method of increasing the resistance to horizontal and vertical planar deflection of a modular structural composite roof deck comprising the steps of; positioning a sheet of corrugated material having a symmetrical rib pattern above and below a neutral axis across horizontally disposed purlins to form a horizontal span of corrugated material such that opposite ends of the span are supported by the purlins; securing lower portions of downwardly extending ribs on the horizontal corrugated sheet to the purlins; positioning a flat horizontally disposed sheet of high density material above the horizontally disposed sheet of corrugated material; and securing mechanical fasteners through the flat sheet and through upwardly extending ribs on the corrugated sheet oriented in a pattern to form a first truss comprising a horizontal section of said flat sheet spanning space between ribs in said corrugated sheet between adjacent mechanical fasteners and downwardly extending connector portions of said corrugated sheet between said ribs in a generally vertical plane extending transversely of the ribs in the corrugated sheet, and a second triangular shaped truss in the horizontal plane of the sheet, said second truss comprising a triangular segment of said flat sheet restrained by adjacent mechanical fasteners to ribs of a corrugated sheet in the span between purlins, said first and second trusses being intermediate opposite ends of the span and extending longitudinally and transversely of the span to prevent lateral and vertical distortion of the corrugated sheet as a results of force applied in the plane of the flat sheet.

6. A modular structural composite roof deck functioning as a structural diaphragm to provide rigidity to a building: spaced purlins; symmetrically corrugated sheet material supported from below and spanning the distance between said purlins; first fastener means securing downwardly extending ribs on the sheet of corrugated material to said purlins to form a horizontal span, said span having ends secured to said first fastener means to said purlins; a flat rigid sheet; and second fastener means mechanically joining the flat rigid sheet to upper ribs on the corrugated sheet between opposite ends of said span, said second fastener means oriented in a pattern at horizontally spaced locations transversely of the span and spaced locations longitudinally of the span to form a series of essentially triangular shaped trusses in the horizontal and vertical planes throughout and across the span between the purlins to stabilize and prevent lateral and vertical deformation of the individual ribs of the corrugated sheet to increase the resistance to horizontal and vertical planar deflection of the roof deck.

7. A modular structural composite roof deck according to claim 6, said flat rigid sheet comprising a plurality of panels having a tongue and groove formed on opposite edges thereof to provide continuous interlocking joints to resist movement of adjacent edges of said panels.

8. A modular structural composite roof deck according to claim 6, said flat rigid sheet comprising: panels of rigid material and panels of insulation material.

* * * * *

UNITED STATES PATENT AND TRADEMARK OFFICE

CERTIFICATE OF CORRECTION

PATENT NO. : 4,736,561

DATED : April 12, 1988

INVENTOR(S) : Dale A. Lehr, Charles L. Nunley

It is certified that error appears in the above-identified patent and that said Letters Patent is hereby corrected as shown below:

Column 11, line 30, change "said flat said sheet" to --said flat rigid sheet--

Column 11, line 37, change "heat exchanger" to --heat exchange--

Column 11, line 53, change "shet" to --sheet--

Column 11, line 61, change "troughts" to --troughs--

Column 13, line 14, change "results" to --result--

Column 13, line 23, change "secured to" to --secured by--.

Signed and Sealed this

Twenty-third Day of August, 1988

*Attest:*

DONALD J. QUIGG

*Attesting Officer*

*Commissioner of Patents and Trademarks*